US005782604A

United States Patent [19]

Luxford

[11] Patent Number: 5,782,604

[45] Date of Patent: Jul. 21, 1998

[54] PUMP

[75] Inventor: Geoffrey Luxford, Northamptonshire, England

[73] Assignee: Domino Printing Sciences, PLC, England

[21] Appl. No.: 760,487

[22] Filed: Dec. 5, 1996

[30] Foreign Application Priority Data

Dec. 19, 1995 [GB] United Kingdom ..... 9525972

[51] Int. Cl.[6] ..... F04D 29/28

[52] U.S. Cl. ..... 415/71; 347/75; 347/85

[58] Field of Search ..... 415/71; 347/38, 347/44, 73, 75, 85

[56] References Cited

U.S. PATENT DOCUMENTS

| | | | |
|---|---|---|---|
| 1,295,621 | 2/1919 | Simond | 415/71 |
| 1,588,160 | 5/1926 | Mauron et al. | 415/71 |
| 3,735,199 | 5/1973 | Ascoli . | |
| 3,781,136 | 12/1973 | Jacobson . | |
| 4,025,225 | 5/1977 | Durant . | |
| 5,496,149 | 3/1996 | Dugan | 415/90 |
| 5,534,904 | 7/1996 | Sheinman | 347/75 |

FOREIGN PATENT DOCUMENTS

| | | |
|---|---|---|
| 1383353 | 2/1964 | France . |
| 969286 | 5/1958 | Germany . |
| 1403894 | 11/1968 | Germany . |
| 14006531 | 7/1975 | United Kingdom . |

*Primary Examiner*—John T. Kwon
*Attorney, Agent, or Firm*—Laff, Whitesel, Conte & Saret, Ltd.

[57] ABSTRACT

A pump (1) has a rotor (4) and a stator (3) disposed closely adjacent to and biased towards it, but spaced apart from a surface of the rotor. The stator (3) or rotor (4) has recesses (30) on its surface facing the rotor or stator respectively, and an inlet to and an outlet from each recess to provide for the supply of fluid to and from the recess. Rotation of the rotor (4) about its axis is arranged to cause fluid to be pumped from the inlet to the outlet as a result of the viscous drag on the fluid resulting from rotation of the rotor relative to the stator (3). The force biasing the rotor (4) and stator (3) together is provided at least in part by fluid pressure feedback from the pump (1) in order to control the clamping or biasing pressure between the rotor and stator automatically.

18 Claims, 5 Drawing Sheets

PUMP

The present invention relates to pumps and, more particularly, to pumps which are capable of providing relatively high fluid pressure with relatively low fluid flow rates.

There is a need for pumps of this type, particularly for so-called continuous ink jet printers. Such printers utilise a stream of droplets to cause printing on an appropriate substrate, fluid being pumped from a reservoir to a print head which includes one or more nozzles through which the droplets issue. However, because it is required to eject fluid from the nozzle at reasonably high pressure, conventionally, gear pumps have been used to create the necessary high pressure with a high flow of fluid, a large part of the fluid, which is not required to pass through the nozzle, thus being recirculated around a by-pass path. The use of such pumps creates large inefficiencies since the pump is required to pump a large amount of fluid which is not required for printing purposes. Additionally, such pumps, as with virtually all conventional pumps, cause small pulsations in the fluid flow and these may be detrimental to the printing process or else may be difficult to overcome.

There is a need therefore to overcome these problems and consideration has been given to using a viscosity type pump of the kind shown in GB-A-1 400 531, which shows a pump which comprises a rotor; a stator disposed closely adjacent to and biased relatively towards the rotor; the stator having plural arcuate pumping grooves in its surface facing the rotor, whereby rotation of the rotor about its axis is arranged to cause fluid to be pumped from an inlet to an outlet as a result of the viscous drag on the fluid resulting from rotation of the rotor relative to the stator. However, pumps of this type are little used, possibly because of the difficulty of obtaining the necessary degree of control of the rotor—stator gap. Other types of viscous pump are shown in FR-A-1 439 499, GB-A-313 531 and U.S. Pat. No. 3 735 199.

According to the present invention there is provided a pump which comprises a rotor; a stator disposed closely adjacent to and biased relatively towards, but spaced apart from a surface of, the rotor; the stator or rotor having plural recesses on its surface facing the rotor or stator respectively, an inlet to and outlet from each recess to provide for the supply of fluid to and from the recess, whereby rotation of the rotor about its axis is arranged to cause fluid to be pumped from the inlet to the outlet as a result of the viscous drag on the fluid resulting from rotation of the rotor relative to the stator; characterised in that the force biasing the rotor and stator together is provided at least in part by fluid pressure feedback from the pump, in order to control the clamping or biasing pressure between the rotor and stator automatically.

As mentioned above, the recesses (or grooves) may be provided in either the rotor or stator and may be provided in the surface of the rotor or stator or in a shim mounted thereon. Additionally, there may be plural stators and/or rotors arranged in a stack; in this way output flow can be increased without changing the pump diameter. Additionally, this extra capacity will allow re-optimisation of the pump design to allow a trade-off of this extra flow to gain additional pressure. The recesses or grooves are preferably of spiral form and the pumping action may be inwards or outwards.

By using fluid pressure feedback, the biasing of the stator relatively towards rotor can be controlled automatically so that, as pressure increases between the rotor and stator tending to push them apart, there is a concomitant increase in the biasing pressure, so that force balancing at the required level is achieved.

Preferably, the fluid pressure feedback is provided via a bellows assembly to which pressure from the pump output side is fed. The bellows assembly may incorporate a preload spring to maintain the loading on the rotor and stator at start-up. Alternatives to a bellows assembly include a piston and cylinder assembly and a diaphragm arrangement.

The pump of the present invention finds particular application in pumping applications where the liquid to be pumped has entrained particulates or tends to coagulate, eg. edible inks, fluorescent inks or pigmented inks.

One advantage of the pump according to the invention is that the pressure and flow generated can be controlled by the pump speed, so avoiding the need for a separate pressure regulator.

Two examples of pumps constructed in accordance with the present invention will now be described with reference to the accompanying drawings, in which.

Figure 1:
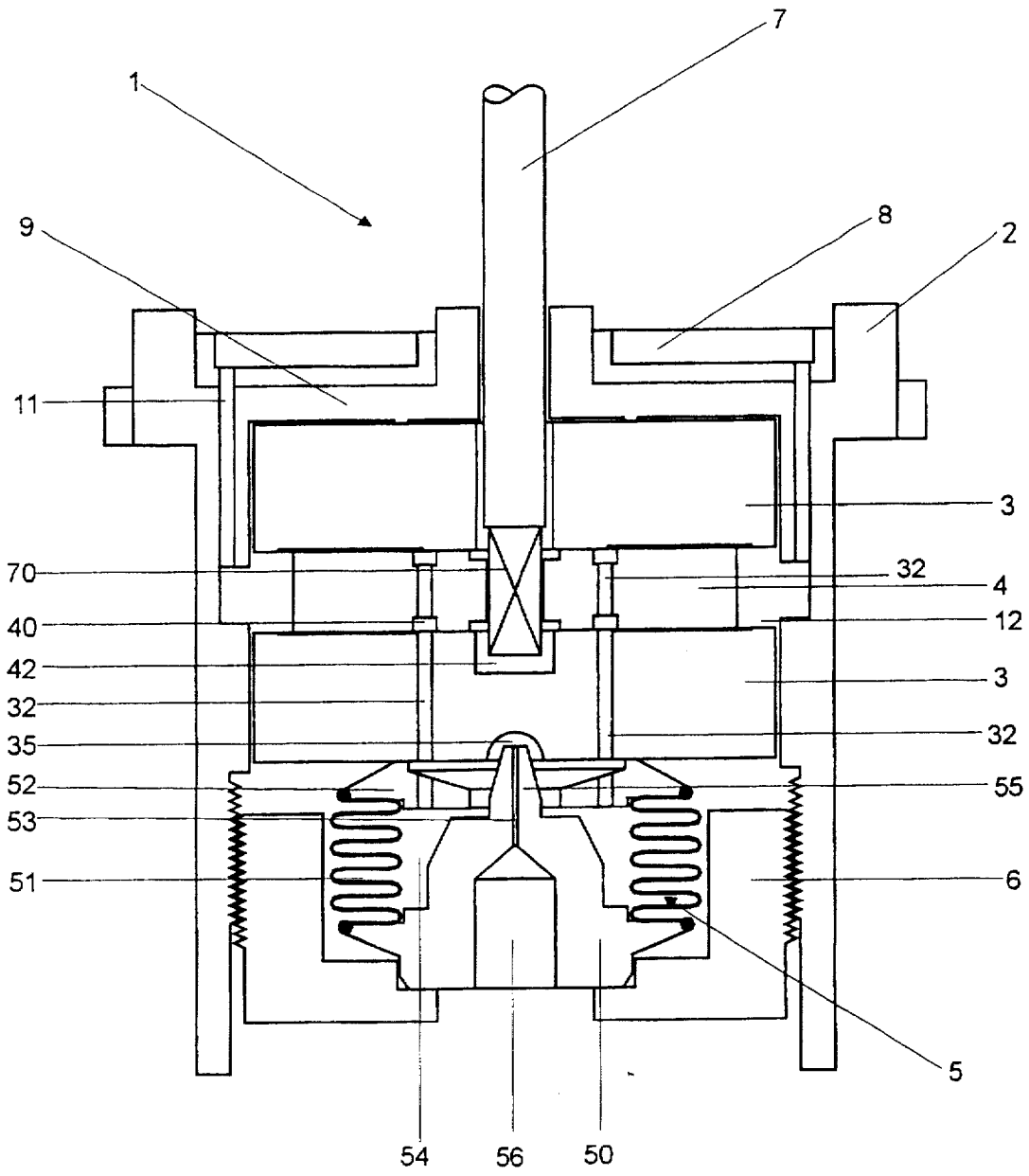
FIG. 1 shows a pump in longitudinal section.

The pump 1 shown in FIG. 1 is a prototype pump, designed to be immersed in the fluid to be pumped, and comprises a generally cylindrical casing 2 in which are mounted a pair of stainless steel stators 3, one on each side of a carbon rotor 4. The rotor 4 and the stators 3 are able to 'float' in the vertical direction of FIG. 1 and the gaps between them are controlled by a force balancing bellows unit 5 bearing against the underside of the lower stator 3.

The bellows unit 5 is supported in an end cap 6 which is screw-threadably mounted in the bottom of the casing 2. This enables the position of the bellows assembly 5 to be adjusted, in turn enabling the 'at rest' position of the stators and rotor to be pre-set. The bellows assembly has a central body 50 which supports a surrounding circular bellows 51 which, in turn, supports a top cap 52 which abuts the underside of the lower stator 3. A sufficiently good static seal is provided there simply by the flatness of the abutting surfaces. Welding the cap to the lower stator would be possible, but has been found not to be necessary in tested applications and could have the result of distorting the lower rotor. The central body 50 has an orifice 53 through which fluid pressure within the cavity 54 formed within the assembly is allowed to flow to the pump output in a controlled fashion. A spigot 55 protrudes into a cavity 35 in the lower side of the stator 3 so that air ingested into the bellows assembly is displaced with output fluid. This ensures automatic expulsion of any air.

In use the pump is operated through a drive shaft 7 which has a square drive dog 70 which fits loosely within a square socket 42 in the rotor 4.

Fluid to be pumped is supplied to the casing 2 through a filter 8 and passes through an axial passage 11 between the inner surface of the casing 2 and the cylindrical outer surface of a top closure socket 9 and hence to the annular space 12 around the rotor 4. In other embodiments, the filter may not be required and ink may be supplied directly to the outer periphery of the rotor through inlet ports in the side of the casing. From the circumference of the rotor, the fluid passes into spiral arcuate grooves 30 in the faces 31 of each of the stators 3 adjacent the rotor 4. The spiral grooves 30 are separated by corresponding lands 34 which act as seals against the rotor 4 to prevent leakage back across the grooves (see FIGS. 2 & 3). There is a balance between power loss due to leakage and power loss due to friction and the lands 34 are considerably narrower than the grooves in order maximise the pumping area while reducing the frictional area of the lands. The grooves 30 have a preferably rectangular cross-section and this has the benefit of being relatively easy to achieve in manufacture whilst ensuring that wear does not significantly affect the form of the grooves, thus avoiding major changes in pumping characteristics due to wear. Grooves of other cross-sections may be advantageous in some circumstances and may have other advantages. The spiral pattern of the grooves will be arranged to suit the pumping requirements and the liquid to be pumped.

At the radially inner portion of the rotor 4 annular collection grooves 40 are provided, into which the fluid is discharged from the inner ends of the stator grooves 30. The rotor collection grooves 40 are connected by passages 41 and the fluid passes from the lower rotor collection groove 40 into passages 32 in the lower rotor 3. After passing out of the bottom of the lower rotor 3, the fluid is discharged into the cavity 54 within the bellows assembly 5 and from there, through the orifice 53 and into a central discharge cavity 56, and thence to the pump outlet through the casing 2. Radially inwardly of the annular collection grooves 40 on the rotor, each of the stators is formed with an annular land 33 which acts as a seal to prevent fluid from passing to the space around the drive shaft 7 and thence to the exterior of the pump. To simplify manufacture, this land has the same height as the lands 34 separating the spiral grooves 30 and operates with the same clearance. Thus, a degree of leakage is provided for in the design and this is optimised so that the power losses due to leakage are offset against the frictional losses that would occur with a closer clearance or wider sealing land.

Figure 2:
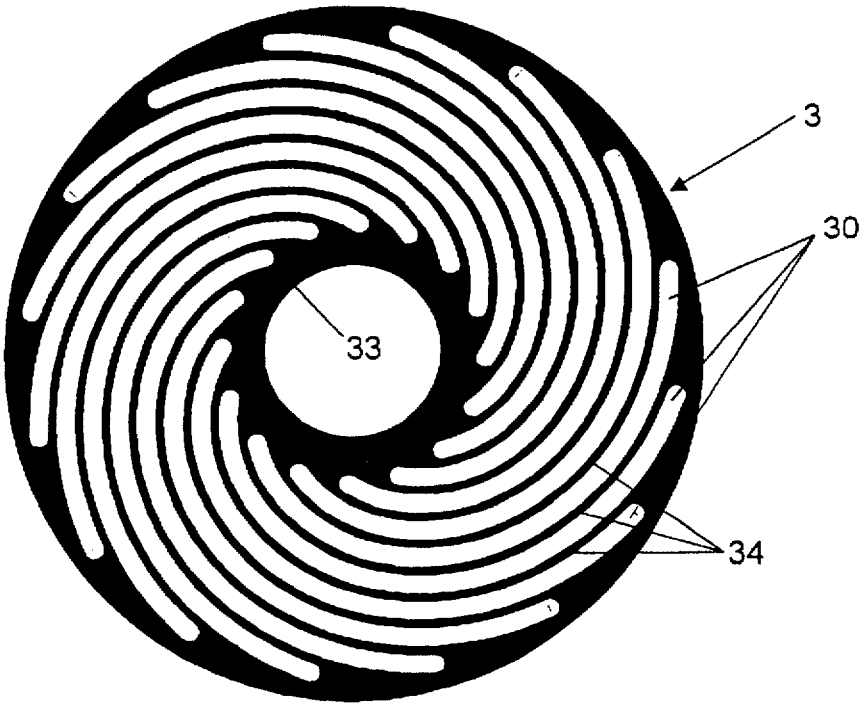
FIG. 2 shows a schematic plan view of pumping grooves which are provided in a stator.
Figure 3:
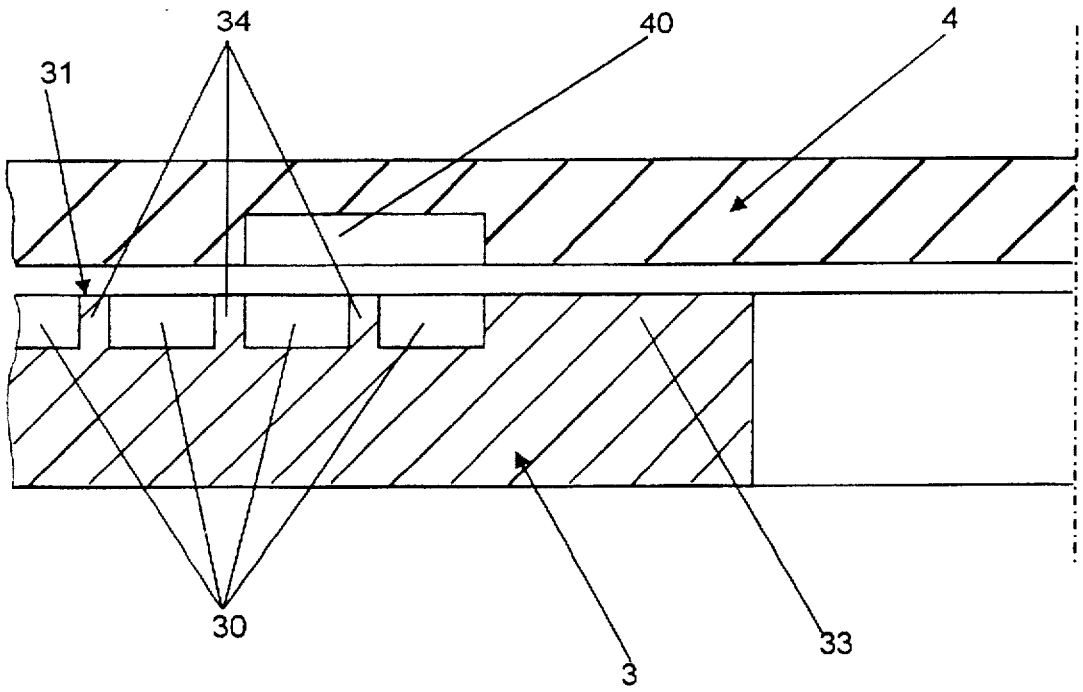
FIG. 3 shows part of a rotor/stator combination in cross-section.
Figure 4:
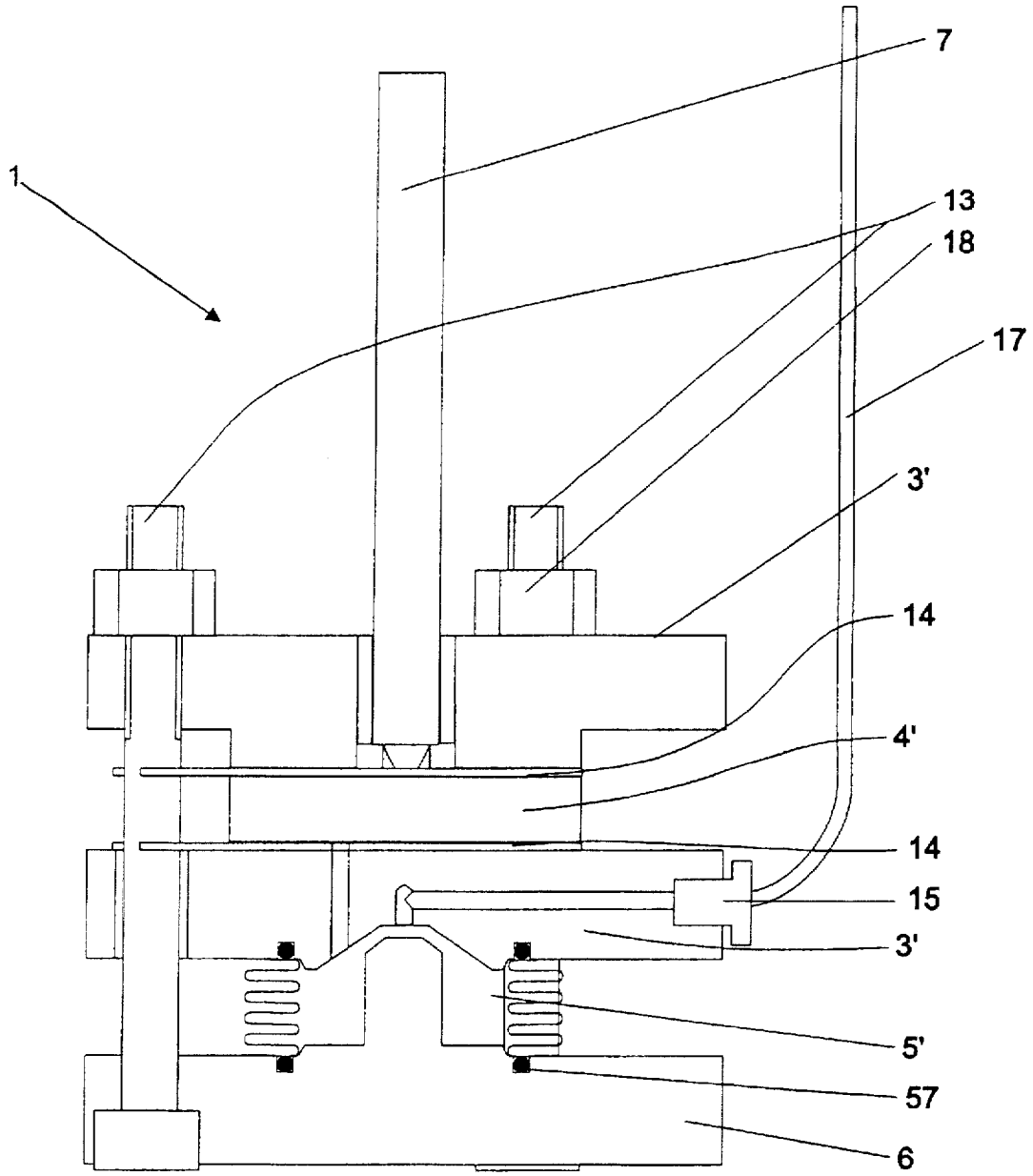
FIG. 4 shows another pump in longitudinal section.

The pump 1' shown in FIG. 4, broadly similar to that of FIGS. 1 to 3 and also designed to be immersed in the fluid to be pumped, has no sealed casing 2. This improves circulation around the pump and prevents the fluid being heated. The rotor 4' and the stators 3' are also able to 'float' in the vertical direction and the gaps between them are also controlled by a force balancing bellows unit 5' bearing against the underside of the lower stator 3'. However, the upper stator 3' has only a slightly larger diameter than the rotor 4' in order that air bubbles are dispersed rather than being drawn into the pump mechanism.

The bellows unit 5' is sealed at the lower end to a bottom clamp plate 6', and at the higher end to the lower stator 3'. These seals 8' may be made by electron beam welding, or, as shown, to reduce cost they may comprise suitably placed O-ring seals 57. The bellows unit 5' may also be moulded in plastic materials or rubber, and possibly as a diaphragm to further reduce cost.

The position of the bellows unit 5' needs to be adjustable, enabling the 'at rest' position of the stators and rotor to be pre-set. This is achieved using three low-cost tie bolts 13 that also provide location for the lower stator 3' and for a pair of stainless steel grooved shims 14 mounted on the surfaces of the stators facing the rotor (see FIG. 6). This method of location is important to prevent vibrational instability. The tie bolts 13 are secured with lock nuts 18.

The grooved shims 14 provide an alternative to the grooved rotor 4 of FIG. 1. Etching the grooves 30 onto shims 14 considerably simplifies manufacture and thus substantially reduces manufacturing costs.

Figure 6:
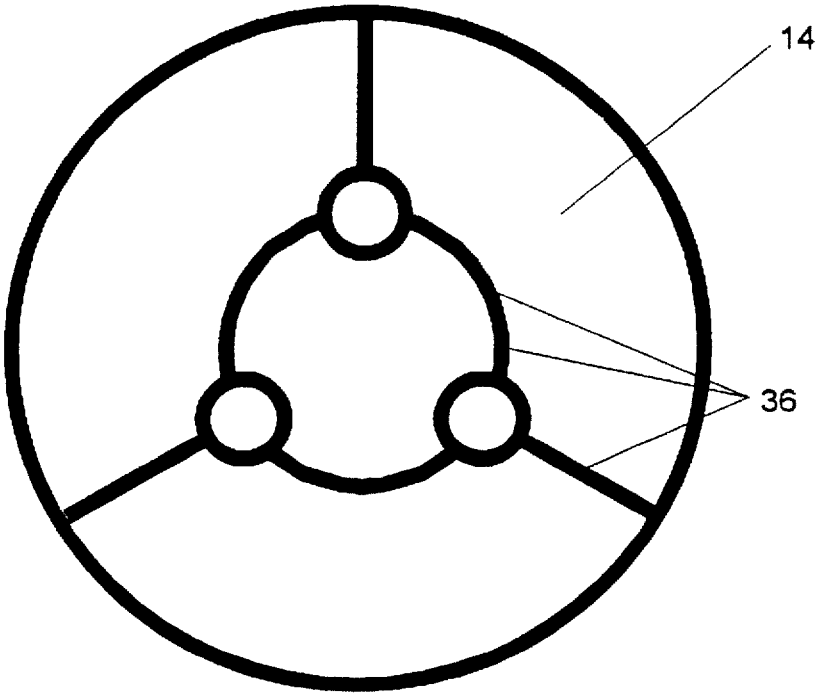
FIG. 6 is a schematic diagram of the reverse side of a shim used in the pump of FIG. 4.

The shims 14 are held in place against the rotor 4' by the pressure difference between the ink in the grooves 30 and the ink in the drainage channels 36 on the reverse side of the shims 14 as shown in FIG. 6. The drainage channels 36 open into the ink reservoir 101 to maintain the pressure in the drainage channels 36 at that of the reservoir 101 in order to create a pressure differential across the shims 14. It should be noted that the drainage channels 36 may alternatively be formed on the opposing surfaces of stators 3', and that various designs of channel arrangement can be envisaged.

The bellows unit 5' has an outlet 15 formed through the lower stator 3' to an outlet pipe 17 through which fluid within the cavity formed within the damper unit 5' is allowed to flow at pressure in a controlled fashion. The outlet pipe 17 may then exit the ink vessel 101 through a mounting block (not shown) that also houses the drive shaft 7 and any other attachments. This means that the ink vessel 101 can be a simple sealed unit detachable from the mounting block as no separate outlet connection through the wall of the ink vessel 101 is required.

It may be useful to operate the pump at a fixed speed, as this reduces the cost of the motor, but this prohibits external control of the output pressure of the pump. A solution is to apply an additional adjustable bias load to the lower backing plate, for example by the spring 113 and control knob 105 illustrated in FIG. 5. As the control knob 105 is turned it adjusts the preset tension of the spring 113 and the load applied to the lower backing plate by the spring is varied. This alters the clearance between the rotor and the stators and so alters the pump output pressure. The mechanism can be set by hand as the pump pressure remains constant over long periods of time, or alternatively an electrical actuator could control an additional bias force mechanism.

It should also be noted that a potential difficulty with pumping some fluids with a pump according to the invention is on start-up. The biasing force of the stators against the rotor means that a high starting torque may be required. In order to overcome this, the drive mechanism may provide for axial movement of the stator(s)/and or rotor(s) on start-up to reduce frictional forces at start-up until sufficient hydrodynamic lubrication has been developed by the pump. This may be achieved by using a helical cam drive between the motor and the drive shaft or between the drive shaft and the end of the rotor/stator stack to drive the stack together only after an initial degree of shaft rotational movement has taken place and the rotor(s) have started to be driven.

Figure 5:
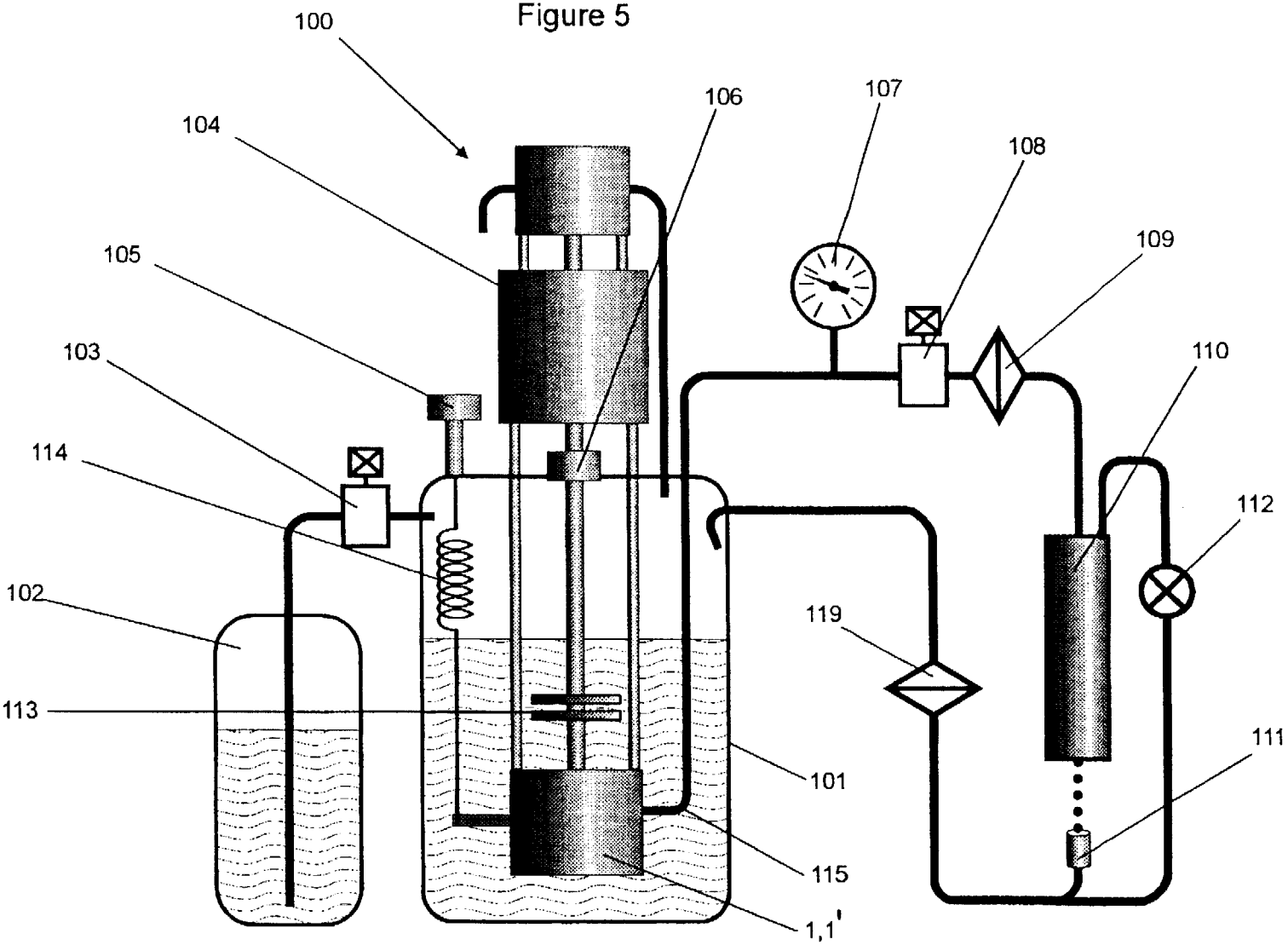
FIG. 5 is a schematic diagram of an example of a system in which the pumps may be utilised.

Referring to FIG. 5, the pump 1,1' may be submersed in an ink vessel 101 to form part of the illustrated ink jet printer system 100. Ink is supplied from an ink supply vessel 102, for example a top-up cartridge or similar, through an ink supply solenoid 103 into the ink vessel 101. The viscosity of the ink may be measured by a viscometer 113. The pump 1,1' located in the ink vessel 101 is driven by a pump motor 104 connected to a drive shaft 7 sealed by a shaft seal 106, and pump pressure can be controlled by a control knob 105, which adjusts a biasing force applied to the lower backing plate by a spring 114. Ink flows at pressure from a pump output 115 through a pressure transducer 107, a head ink solenoid 108, and a head ink filter 109, to a print head 110. As is conventional, ink not used for printing is returned from a gutter 111 or through a manually adjustable bleed valve 112 to the ink vessel 101 via a further filter 119 and so is not lost from the system 100.

I claim:

1. A pump comprising a rotor;

a stator disposed closely adjacent to and biased by a force relatively towards, but spaced apart from, the rotor;

a surface forming a plurality of recesses, said surface selected from the group consisting of a surface on said stator facing said rotor, and a surface on said rotor facing said stator;

an inlet to and outlet from each recess to provide for the supply of fluid to and from the recess, whereby rotation of the rotor about its axis is arranged to cause fluid to be pumped from the inlet to the outlet as a result of the viscous drag on the fluid resulting from rotation of the rotor relative to the stator;

the force biasing the rotor and stator being provided at least in part by fluid pressure feedback from the pump, in order to automatically control the biasing force between the rotor and stator.

2. A pump according to claim 1, wherein said rotor and said stator are arranged in a stack, said stack having additional means to pump the supply of fluid, said additional means to pump the supply of fluid selected from the group consisting of: an additional stator, an additional rotor, and a combination of said additional stator and additional rotor.

3. A pump according to claim 1 or claim 2, wherein the recesses are of spiral form.

4. A pump according to claim 1 or claim 2, wherein the inlets and the outlets cause the pumping action to be outwards.

5. A pump according to claim 1 or claim 2, wherein the inlets are radially outward of the outlets whereby the pumping action is inwards.

6. A pump according to claim 1, wherein said surface on said stator facing said rotor is a shim and said surface on said rotor facing said stator is a shim.

7. A pump according to claim 6, wherein said surface forming a plurality of recesses is held against the rotor by the pressure of the ink in the recesses.

8. A pump according to claim 1 or claim 2, wherein the surface on said stator facing said rotor is a surface which forms part of said stator and is integral with said stator, and said surface on said rotor facing said stator is a surface forming part of said rotor and is integral with said rotor.

9. A pump according to claim 1 or claim 2, wherein an additional biasing force apparatus provides an additional adjustable biasing force to alter the pressure produced by the pump independently of the fluid pressure feedback.

10. A pump according to claim 9, wherein the additional adjustable biasing force apparatus comprises a spring and a means for adjusting the preset tension of the spring.

11. A pump comprising:

a rotor;

a stator disposed closely adjacent to and biased by a force relatively towards, but spaced apart from, the rotor;

a surface forming a plurality of recesses, said surface selected from the group consisting of a surface on said stator facing said rotor, and a surface on said rotor facing said stator;

an inlet to and outlet from each recess to provide for the supply of fluid to and from the recess, whereby rotation of the rotor about its axis is arranged to cause fluid to be pumped from the inlet to the outlet as a result of the viscous drag on the fluid resulting from rotation of the rotor relative to the stator;

the force biasing the rotor and stator being provided at least in part by fluid pressure feedback from the pump, in order to automatically control the biasing force between the rotor and stator; and wherein the fluid pressure feedback is provided by means of a bellows assembly to which pressure from the pump output side is fed.

12. A pump according to claim 11, wherein the bellows assembly, incorporates a preload spring to maintain the loading on the rotor and stator at start-up.

13. A pump according to claim 12 wherein said rotor and said stator are arranged in a stack, said stack having additional means to pump the supply of fluid, said additional means to pump the supply of fluid selected from the group consisting of: an additional stator, an additional rotor, and a combination of said additional stator and additional rotor.

14. A pump according to claim 11 wherein said rotor and said stator are arranged in a stack, said stack having additional means to pump the supply of fluid, said additional means to pump the supply of fluid selected from the group consisting of: an additional stator, an additional rotor, and a combination of said additional stator and additional rotor.

15. A pump comprising:

a rotor;

a stator disposed closely adjacent to and biased by a force relatively towards, but spaced apart from, the rotor;

a surface forming a plurality of recesses, said surface selected from the group consisting of a surface on said stator facing said rotor, and a surface on said rotor facing said stator;

an inlet to and outlet from each recess to provide for the supply of fluid to and from the recess, whereby rotation of the rotor about its axis is arranged to cause fluid to be pumped from the inlet to the outlet as a result of the viscous drag on the fluid resulting from rotation of the rotor relative to the stator;

the force biasing the rotor and stator being provided at least in part by fluid pressure feedback from the pump, in order to automatically control the biasing force between the rotor and stator; and wherein the fluid pressure feedback is provided by means of a piston and cylinder assembly to which pressure from the pump output side is fed.

16. A pump according to claim 15 wherein said rotor and said stator are arranged in a stack, said stack having additional means to pump the supply of fluid, said additional means to pump the supply of fluid selected from the group consisting of: an additional stator, an additional rotor, and a combination of said additional stator and additional rotor.

17. A pump comprising:

a rotor;

a stator disposed closely adjacent to and biased by a force relatively towards, but spaced apart from, the rotor;

a surface forming a plurality of recesses, said surface selected from the group consisting of a surface on said stator facing said rotor, and a surface on said rotor facing said stator;

an inlet to and outlet from each recess to provide for the supply of fluid to and from the recess, whereby rotation of the rotor about its axis is arranged to cause fluid to be pumped from the inlet to the outlet as a result of the viscous drag on the fluid resulting from rotation of the rotor relative to the stator;

the force biasing the rotor and stator being provided at least in part by fluid pressure feedback from the pump, in order to automatically control the biasing force between the rotor and stator; and wherein the fluid pressure feedback is provided by means of a membrane and cylinder assembly to which pressure from the pump output side is fed.

18. A pump according to claim 17 wherein said rotor and said stator are arranged in a stack, said stack having additional means to pump the supply of fluid, said additional means to pump the supply of fluid selected from the group consisting of: an additional stator, an additional rotor, and a combination of said additional stator and additional rotor.

* * * * *